US011331724B2

(12) United States Patent
Wang et al.

(10) Patent No.: US 11,331,724 B2
(45) Date of Patent: May 17, 2022

(54) APPARATUS AND METHOD FOR EFFICIENTLY PREPARING ULTRAFINE SPHERICAL METAL POWDER BY ONE-BY-ONE DROPLETS CENTRIFUGAL ATOMIZATION METHOD

(71) Applicants: Xiaoming Wang, Beijing (CN); Yang Zhao, Beijing (CN); Wenyu Wang, Beijing (CN); Qing Chang, Beijing (CN); Zhiqiang Ren, Beijing (CN);

(Continued)

(72) Inventors: Xiaoming Wang, Beijing (CN); Yang Zhao, Beijing (CN); Wenyu Wang, Beijing (CN); Wei Dong, Liaoning (CN); Yao Meng, Liaoning (CN); Qing Chang, Beijing (CN); Zhiqiang Ren, Beijing (CN); Jing Shi, Beijing (CN); Guofeng Han, Beijing (CN); Sheng Zhu, Beijing (CN); Tao Teng, Beijing (CN); Fumin Xu, Liaoning (CN); Zhaofeng Bai, Liaoning (CN); Yanyang Wang, Liaoning (CN); Yang Han, Liaoning (CN); Guobin Li, Liaoning (CN); Yu Sun, Beijing (CN); Zhiyong Qin, Beijing (CN)

(73) Assignees: Xiaoming Wang, Beijing (CN); Yang Zhao, Beijing (CN); Wenyu Wang, Beijing (CN); Qing Chang, Beijing (CN); Zhiqiang Ren, Beijing (CN);

(Continued)

( * ) Notice: Subject to any disclaimer, the term of this patent is extended or adjusted under 35 U.S.C. 154(b) by 0 days.

(21) Appl. No.: 17/280,025

(22) PCT Filed: Sep. 25, 2019

(86) PCT No.: PCT/CN2019/107704

§ 371 (c)(1),
(2) Date: Mar. 25, 2021

(87) PCT Pub. No.: WO2020/063626

PCT Pub. Date: Apr. 2, 2020

(65) Prior Publication Data

US 2021/0308763 A1 Oct. 7, 2021

(30) Foreign Application Priority Data

Sep. 25, 2018 (CN) ..... 201811116579.2

(51) Int. Cl.
*B22F 9/10* (2006.01)
*B22F 1/065* (2022.01)
*C22C 13/00* (2006.01)

(52) U.S. Cl.
CPC ..... *B22F 9/10* (2013.01); *B22F 1/065* (2022.01); *B22F 2201/11* (2013.01); *B22F 2301/30* (2013.01); *C22C 13/00* (2013.01)

(58) Field of Classification Search
CPC ..... B22F 9/10; B22F 9/08
See application file for complete search history.

(56) References Cited

U.S. PATENT DOCUMENTS 2,897,539 A * 8/1959 McMillan ..... B22F 9/10 75/334
4,315,720 A * 2/1982 Ueda ..... B01J 2/04 425/8

(Continued)

FOREIGN PATENT DOCUMENTS

CN 101147974 A 3/2008
CN 104525961 A 4/2015

(Continued)

*Primary Examiner* — Kevin E Yoon
*Assistant Examiner* — Austin Pollock
(74) *Attorney, Agent, or Firm* — Novick, Kim & Lee, PLLC; Allen Xue

(57) ABSTRACT

An apparatus efficiently preparing ultrafine spherical metal powder includes a housing, a crucible and a powder collec- (Continued)

tion area arranged in the housing. The turnplate arranged in the powder collection area is an inlaid structure. The part inlaid into the body part acts as an atomization plane of the turnplate. The atomization plane is provided with a concentric circular groove, and the turnplate is provided with an air hole. The apparatus is used for preparing ultrafine spherical metal powder by on-by-one droplets centrifugal atomization method, mainly combining the uniform droplet jet method and the centrifugal atomization method, which breaks through the traditional metal splitting model, makes the molten metal in a fibrous splitting, so as to efficiently prepare ultrafine spherical metal powder with narrow particle size distribution interval, high sphericity, good flowability, excellent spreadability, uniform and controllable size, no satellite droplets and suitable for industrial production.

10 Claims, 2 Drawing Sheets

(71) Applicants: Guofeng Han, Beijing (CN); Sheng Zhu, Beijing (CN); Jing Shi, Beijing (CN); Tao Teng, Beijing (CN); Yu Sun, Beijing (CN); Zhiyong Qin, Beijing (CN); DALIAN UNIVERSITY OF TECHNOLOGY, Liaoning (CN)

(73) Assignees: Guofeng Han, Beijing (CN); Sheng Zhu, Beijing (CN); Jing Shi, Beijing (CN); Tao Teng, Beijing (CN); Yu Sun, Beijing (CN); Zhiyong Qin, Beijing (CN); DALIAN UNIVERSITY OF TECHNOLOGY, Liaoning (CN)

(56) References Cited

U.S. PATENT DOCUMENTS

| | | | | | |
|---|---|---|---|---|---|
| 4,323,523 | A | | 4/1982 | Ueda et al. | |
| 4,648,820 | A | * | 3/1987 | Scruggs | B22F 1/0055 264/8 |
| 4,900,355 | A | * | 2/1990 | Tanno | B22F 9/10 75/334 |
| 5,188,168 | A | | 2/1993 | Pond | |
| 5,340,377 | A | * | 8/1994 | Accary | B22F 9/08 75/334 |
| 2012/0157320 | A1 | * | 6/2012 | Yamada | B23P 15/26 165/4 |
| 2016/0348222 | A1 | * | 12/2016 | Isaac | C22C 38/30 |
| 2021/0187611 | A1 | * | 6/2021 | Valls Angles | B33Y 70/00 |

FOREIGN PATENT DOCUMENTS

| | | | | | |
|---|---|---|---|---|---|
| CN | 104550988 | A | | 4/2015 | |
| CN | 104550990 | A | * | 4/2015 | |
| CN | 104588674 | A | * | 5/2015 | |
| CN | 104588674 | A | | 5/2015 | |
| CN | 205254120 | U | * | 5/2016 | |
| CN | 106392088 | A | * | 2/2017 | |
| CN | 107350477 | A | * | 11/2017 | B22F 9/10 |
| CN | 107350477 | A | | 11/2017 | |
| CN | 107570721 | A | | 1/2018 | |
| CN | 109128206 | A | | 1/2019 | |
| JP | S63145703 | A | | 6/1988 | |
| JP | 2009062573 | A | | 3/2009 | |

* cited by examiner (a) (b)

APPARATUS AND METHOD FOR EFFICIENTLY PREPARING ULTRAFINE SPHERICAL METAL POWDER BY ONE-BY-ONE DROPLETS CENTRIFUGAL ATOMIZATION METHOD

TECHNICAL FIELD

The present disclosure belongs to the technical field for preparing ultrafine spherical particles, specifically relates to an apparatus and a method for efficiently preparing ultrafine spherical metal powder by drop-by-drop centrifugal atomization method.

BACKGROUND ART

Metal additive manufacturing technology has been widely used, because of its wide range of molding and its ability, in energy sources, military and other fields to process various parts with complex shapes. As the raw material for molding, the quality of the spherical metal powder has great influence on that of the final products. The requirements of additive manufacturing technology for metal powder include the performances such as narrow particle size distribution, low oxygen content, high sphericity, average particle size less than 50 μm, and satellite droplets free. However, at present, the quality of metal powder in China's market is lower, which has a big gap with foreign technical level. The powder in the market cannot meet the needs of additive technology, which seriously limits the development of additive technology in our country.

At present, the main method for preparing spherical metal powder is atomization method, including gas atomization method, water atomization method, centrifugal atomization method, rotating electrode atomization method, etc. Although the atomization method has a very high efficiency, the size dispersity of the prepared powder is large, and powder that meets a particle size requirement can be obtained only through multiple screening, which greatly reduces the production efficiency, especially when the size is strictly required. Satellite droplets are easily produced by using the atomization method, which makes the surface of the powder adhere to the satellite droplet, thereby reducing the flowability and spreadability of the powder. Moreover, it is easy to be incorporated with impurities in the production process, which cannot meet the requirements of the powder for 3D printing.

Therefore, how to prepare metal powder with narrow particle size distribution, controllable, high sphericity and no satellite droplets has become a big problem to be solved.

SUMMARY OF THE INVENTION

According to the above mentioned technical problems of poor sphericity, spreadability and flowability in the process of preparing metal powder for 3D printing, the present disclosure provides an apparatus and a method for efficiently preparing ultrafine spherical metal powder by drop-by-drop centrifugal atomization method. Combining the uniform droplet spray method and the centrifugal atomization method, a nozzle with a plurality of small holes is arranged at the uniform droplet spray part, at the same time, the structure of the turnplate is designed and an induction heating coil is added to perform induction heating on a surface of the disc plate, thereby the metal liquid breaks through the traditional split mode of molten metal, and implements the fibrous split mode which can be implemented only when the atomizing medium is aqueous solution or organic solution. Though this mode, the ultrafine refinement of metal powder can be prepared and a great leap can be made in particle size control. Spherical metal powder with high sphericity, good flowability and spreadability, satellite droplets free and a very high fine powder yield that meets the requirements of 3D printing may be prepared.

The technical solutions adopted by the present disclosure are as follows:

An apparatus for efficiently preparing ultrafine spherical metal powder by means of drop-by-drop centrifugal atomization process, including a housing, a crucible and a powder collection area arranged in the housing. The powder collection area is arranged at the bottom of the housing and the crucible is arranged above the powder collection area.

The crucible is provided with a thermocouple inside and a heating tape outside. The crucible is provided, at the bottom, with a nozzle with a plurality of small holes. The crucible is provided with an oscillation generator connected with a piezoelectric ceramic arranged on the top of the housing. An plate electrode is arranged right below the crucible.

The housing is provided with a crucible air inlet extending into the crucible. The housing is also provided with a diffusion pump and a mechanical pump. The housing is also provided with a cavity air inlet and a cavity exhaust valve.

The powder collection area includes a collection tray arranged at the bottom of the housing, and a turnplate arranged above the collection tray and connected with a motor for atomizing metal droplets.

The turnplate includes a base, an atomization plane and an air hole.

The base is a structure of a "T-shaped" longitudinal section constituted of an upper receiving portion and a lower support portion. The upper surface of the receiving portion is provided with a circular groove with a certain radius coaxial with the center of the receiving portion. The base is made of a material with a thermal conductivity less than 20 W/m/k. The atomization plane is also provided with a concentric circle groove matching the nozzle with a plurality of small holes.

The atomization plane is a disc structure, matching with the circular groove and in interference fitting with the circular groove. The atomization plane is made of a material with wetting angle less than 90° to the atomized metal droplet.

The air hole is through arranged passing through the receiving portion and the support portion.

The upper end of the air hole is in contact with the lower end of the atomization plane, and the lower end of the air hole is communicated with the outside world.

An induction heating coil is also arranged outside the turnplate.

The volume of the housing should be large enough to make the centrifugally broken droplets fly onto the collection tray at the bottom, so as to ensure that the droplets will not solidify on the inner wall of the housing. The area of the collection tray should be large enough to collect powder.

Preferably, the height of the support portion of the base should not be too high, which should be smaller than the height of the receiving portion. The upper end face of the atomization plane protrudes from the upper end face of the receiving portion with a protrusion height ranging from 0.1 mm to 0.5 mm. The protrusion height should meet the condition that the dispersed metal droplets directly fly into the cavity and fall into the collection tray without touching the base. The base is made of a material with thermal conductivity less than 20 W/m/k, such as zirconia ceramic, silica glass or stainless steel. The upper end face of the air hole is less than or equal to the lower end face of the atomization plane. The air hole is provided to pump the gas in the gap of the turnplate more cleanly during vacuumizing, so that the turnplate is safer when rotating at a high speed. Therefore, the larger the contact area between the upper end face of the air hole and the lower end face of the atomization plane, the better the stability of the atomization plane when vacuuming.

Further, a wetting angle between the material of the crucible and the melt in the crucible is greater than 90°.

Further, an aperture of the small hole of the nozzle ranges from 0.02 mm to 2.0 mm.

Further, a voltage of the plate electrode ranges from 100 V to 400 V. The induction heating coil is connected with a frequency converter and a stabilized voltage supply arranged outside the housing. The heating thickness of the induction heating coil ranges from 5 mm to 20 mm, and a voltage control of the stabilized voltage supply ranges from 0 v to 50 V.

Further, a rotational speed of the turnplate ranges from 10000 rpm to 50000 rpm.

Further, the piezoelectric ceramic, the oscillation generator, the crucible, the nozzle, the plate electrode the turnplate, the concentric circle groove and the induction heating coil are located coaxially from top to bottom of the apparatus.

The present disclosure also discloses a method for efficiently preparing ultrafine spherical metal powder by means of drop-by-drop centrifugal atomization process, including the following steps:

S1. charging: charging the metal material into the crucible arranged in the upper portion of the housing, and manually adjusting, in the height direction, a distance between the induction heating coil and the turnplate to a preset distance, then sealing the housing.

S2. vacuumizing: vacuumizing the crucible and the housing by using the mechanical pump and the diffusion pump, and filling the crucible and the housing with a high-purity inert shielding gas, to make the pressure inside the housing reach a preset value.

S3. heating the crucible: setting the heating parameters of the heating tape according to a melting point of the metal material to-be-heated, monitoring the temperature inside the crucible in real time by the thermocouple arranged in the crucible, and maintaining the temperature after the metal material is completely melted.

S4. induction heating: enabling the turnplate to rotate at a preset high speed by using the motor, and heating the upper surface of the turnplate rotating at the high speed to a temperature higher than a melting point of the metal material by using the induction heating coil.

S5. making the powder: introducing a high-purity inert shielding gas into the crucible by using the crucible air inlet arranged on the housing and extending into the crucible, to form a positive pressure difference between the inside and the outside of the crucible; then inputting a pulse signal with a certain wave mode to the piezoelectric ceramic, so that the oscillation generator (3) generating a certain frequency of oscillation; and then, setting the voltage of the plate electrode to form an electric field of a preset strength.

Because of existence of the pressure difference between the inside and the outside of the crucible, the molten metal flows out through the nozzle to form a columnar metal flow. At this time the columnar mental flow is broken into a series of small metal droplet under a certain frequency of oscillation. In the falling process of the metal droplets and under the effect of electric field, the metal droplets repel each other due to the surface effect of electric charge to avoid the repolymerization of metal droplets.

The metal droplets land freely on the turnplate rotating at a high speed. The metal droplets first drop in the concentric circular groove in the center of the turnplate and gradually spill over the groove. Because the centrifugal force is small at this time, the droplets will not disperse immediately, but spread in a circle on the turnplate. When the droplets spread in a certain range and the centrifugal force is large enough, the spread metal disperse on the turnplate to the edge of the turnplate in a fiber line shape under the action of centrifugal force, and finally split into tiny droplets to fly out. The tiny droplets solidify without a container in the falling process to form the metal powder and fall onto a collection tray.

S6. collecting the powder: collecting the metal powder by the collection tray arranged at the bottom of the housing.

Further, an added amount of the charged metal material range from ¼ to ¾ of a capacity of the crucible.

Further, the position of the induction heating coil is manually adjusted to be 1 mm to 2 mm higher than the turnplate.

Further, the high-purity inert shielding gas is argon or helium gas, which is filled into the housing to make the pressure in the housing reach 0.1 MPa. A holding time is 15 minutes to 20 minutes after the metal material completely melted.

Further, an induction heating voltage of the induction heating coil ranges from 0 to 50V, and an induction heating time ranges from 5 to 15 minutes.

Further, a pressure difference between the crucible and the housing ranges from 0 to 200 kPa.

Compared with the prior art, the present disclosure has the following advantages:

The present disclosure designs an apparatus combining a uniform droplet spray method and a centrifugal atomization method to prepare ultrafine spherical metal powder by metal droplets in a fibrous splitting mode. A melted metal material in the crucible is sprayed through the nozzle with small holes at the bottom of the crucible, under the action of the pressure difference and the oscillation generator, to form small droplets. In the falling process, the small droplets will not aggregate under the action of electric field. The droplets land on the turnplate rotating at a high speed, and first drop in the concentric circular groove in the center of the turnplate and gradually spill over the groove. Due to the effect of induction heating, the uniform droplets will be still in a molten state when they reach the upper surface of the turnplate. Because the droplet metal and the material of the upper surface of the turnplate have good wettability and under the action of centrifugal force, the uniform droplets will spread out in a fibrous shape on the turnplate, and split into tiny droplets at the edge of the turnplate to fly out, then freely fall and solidify to form metal powder. The particle size of metal particles produced by the uniform droplet spray method is controllable, but the production of single-orifice preparing particles is not enough to meet the increasing demand. By combining the uniform droplet spray method centrifugal atomization method, designing the structure of the turnplate, selecting the material with good wettability to the metal is selected as the atomization surface and adding the induction heating device, the present disclosure realizes the fibrous splitting mode of the molten metal, which effectively reduces the diameter of the atomized powder and greatly improve the productivity of the metal powder. Therefore, the metal powder obtained by the combination of the two methods has fine particle size, narrow particle size distribution interval, high sphericity, controllable particle size distribution, consistent thermal history, high yield of fine powder, meeting the requirements of industrial production.

The method of the present disclosure is highly controllable, which is shown in the following aspects: A heating temperature of the crucible can be accurately controlled by using the heating tape. A pressure difference between the crucible and the housing can be controlled by introducing an inert gas into the crucible and the housing. The size of the uniform droplets may be controlled by the size of the nozzle with a plurality of small holes at the bottom of the crucible. The plate electrode can control the electric filed. The induction heating coil can control the temperature of the surface of the turnplate and the rotational speed of the turnplate is controllable, which can control a fibrous splitting effect of the molten metal, thereby further controlling the particle size distribution of the metal particles. The process parameters can be adjusted and controlled to obtain spherical metal powder meeting different requirements of particle sizes and distribution, and the production efficiency is high.

The present disclosure can efficiently prepare metal powder required by 3D printing by means of the fibrous splitting of molten metal. The prepared powder has controllable particle size, small particle size, narrow particle size distribution interval, high sphericity, satellite droplets free, good flowability and spreadability, consistent thermal history, high production efficiency, low production cost. The present disclosure can be used for industrial production.

BRIEF DESCRIPTION OF THE DRAWINGS

To describe the technical solutions in the embodiments of the present disclosure or in the prior art more clearly, the following briefly describes the accompanying drawings required for describing the embodiments or the prior art. Apparently, the accompanying drawings in the following description show some embodiments of the present disclosure, and a person of ordinary skill in the art may still derive other accompanying drawings from these accompanying drawings without creative efforts.

Figure 1:
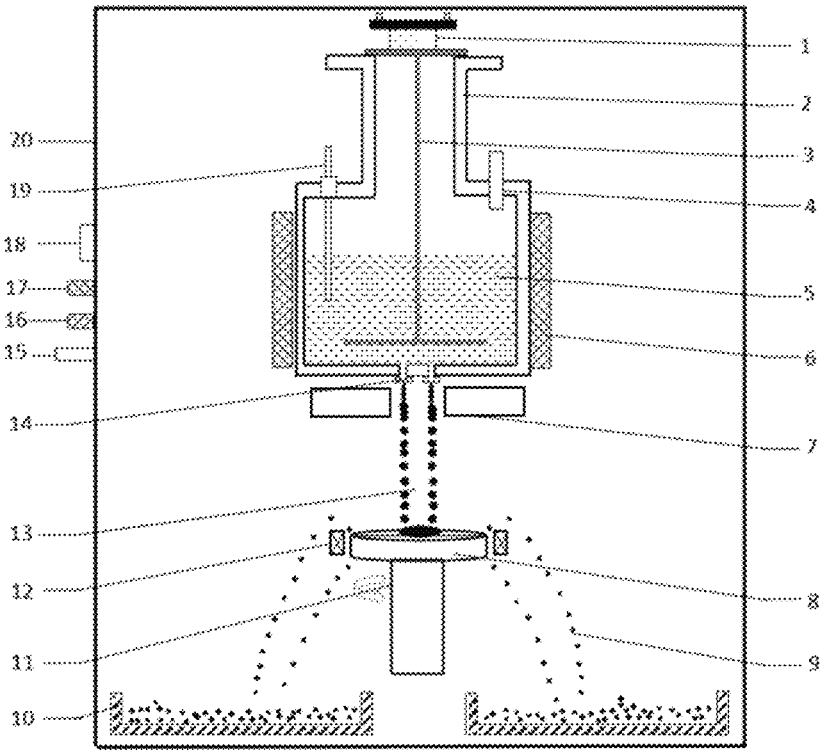
FIG. 1 is a structural schematic diagram of the apparatus in the present disclosure.

In the figures: 1. piezoelectric ceramic; 2. crucible; 3. oscillation generator; 4. crucible air inlet; 5. melt; 6. heating tape; 7. plate electrode; 8. turnplate; 9. metal powder; 10. collection tray; 11. motor; 12. induction heating coil; 13. metal droplet; 14. nozzle; 15. cavity air inlet; 16. mechanical pump; 17. diffusion pump; 18. cavity exhaust value; 19. thermocouple; 20. housing; 21. receiving portion; 22. support portion; 23. atomization plane; 24. air hole; 25. concentric circular groove.

DESCRIPTION OF THE EMBODIMENTS

It should be noted that, in the case of no conflicts, the embodiments and the features in the embodiments of the present disclosure can be combined mutually. The present disclosure will be described in detail below with reference to the accompanying drawings and the embodiments.

To make the objectives, technical solutions, and advantages of the present disclosure clearer, the following clearly and completely describes the technical solutions in the embodiments of the present disclosure with reference to the accompanying drawings in the embodiments of the present disclosure. Apparently, the described embodiments are merely some rather than all of the embodiments. The following description of at least one exemplary embodiment is actually only illustrative, and in no way serves as any limitation on the present invention and its application or use. Based on the embodiments of the present disclosure, all the other embodiments obtained by those of ordinary skill in the art without inventive effort are within the protection scope of the present disclosure.

It should be noted that the terms used herein are only intended to describe specific embodiments and are not intended to limit the exemplary embodiments of the present disclosure. As used herein, unless indicated obviously in the context, a singular form is intended to include a plural form. Furthermore, it should be further understood that the terms "include" and/or "comprise" used in this specification specify the presence of features, steps, operations, devices, components and/or of combinations thereof.

Unless specifically stated otherwise, the relative arrangement of components and steps, numerical expressions, and numerical values set forth in these embodiments do not limit the scope of the present disclosure. In addition, it should be clear that, for ease of description, sizes of the various components shown in the accompanying drawings are not drawn according to actual proportional relationships. Technologies, methods, and devices known to those of ordinary skill in the relevant fields may not be discussed in detail, but where appropriate, the technologies, methods, and devices should be considered as a part of the authorization specification. In all the examples shown and discussed herein, any specific value should be interpreted as merely being exemplary rather than limiting. Therefore, other examples of the exemplary embodiment may have different values. It should be noted that similar reference signs and letters represent similar items in the accompanying drawings below. Therefore, once an item is defined in one accompanying drawing, the item does not need to be further discussed in a subsequent accompanying drawing.

In the description of the present disclosure, it should be noted that orientations or position relationships indicated by orientation terms "front, rear, upper, lower, left, and right", "transverse, vertical, perpendicular, and horizontal", "top and bottom", and the like are usually based on orientations or position relationships shown in the accompanying drawings, and these terms are only used to facilitate description of the present disclosure and simplification of the description. In the absence of description to the contrary, these orientation terms do not indicate or imply that the apparatus or element referred to must have a specific orientation or be constructed and operated in a specific orientation, and therefore cannot be understood as a limitation on the protection scope of the present disclosure: orientation words "inner and outer" refer to the inside and outside relative to the contour of each component.

For ease of description, spatially relative terms such as "on", "over", "on the upper surface", and "above" can be used here to describe a spatial positional relationship between one device or feature and another device or feature shown in the figures. It should be understood that the spatially relative terms are intended to include different orientations in use or operation other than the orientation of the device described in the figure. For example, if the device in the figure is inverted, the device described as "above another device or structure" or "on another device or structure" is then be positioned as being "below another device or structure" or "beneath a device or structure". Therefore, the exemplary term "above" can include both orientations "above" and "below". The device can also be positioned in other different ways (rotating by 90 degrees or in another orientation), and the spatially relative description used herein is explained accordingly.

In addition, it should be noted that using terms such as "first" and "second" to define components is only for the convenience of distinguishing the corresponding components. Unless otherwise stated, the foregoing words have no special meaning and therefore cannot be understood as a limitation on the protection scope of the present disclosure.

As shown in FIG. 1, the present disclosure provides an apparatus for efficiently preparing ultrafine spherical metal powder by means of drop-by-drop centrifugal atomization process, including a housing 20, a crucible 2 and a powder collection area arranged in the housing 20. The powder collection area is arranged at the bottom of the housing 20 and the crucible 2 is arranged above the powder collection area.

The crucible 2 is provided with a thermocouple 19 inside and a heating tape 6 outside. The crucible 2 is provided at the bottom with a nozzle 14 with a plurality of small holes. The wetting angle between the material of the crucible 2 and the melt 5 arranged in the crucible is greater than 90°. The aperture of the small hole of the nozzle 14 ranges from 0.02 mm to 2.0 mm. The crucible 2 is provided inside with an oscillation generator 3 connected with a piezoelectric ceramic 1 arranged on the top of the housing. A plate electrode 7, with a voltage range of 100V to 400V, is arranged right below the crucible.

The housing 20 is provided with a crucible air inlet 4 extending into the crucible 2, and is also provided with a diffusion pump 17, a mechanical pump 16, a cavity air inlet 15 and a cavity exhaust valve 18.

The powder collection area includes a collection tray 10 arranged at the bottom of the housing 20, and a turnplate 8 arranged above the collection tray 10 and connected with a motor 11 for atomizing metal droplets.

Figure 2:
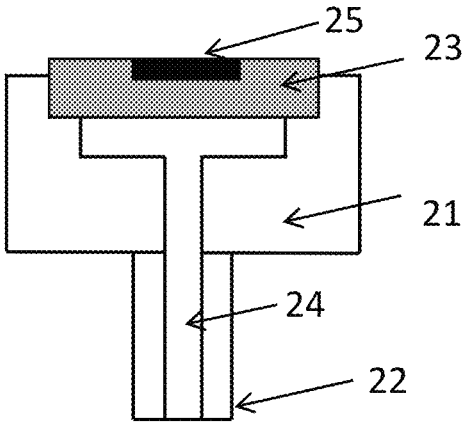
FIG. 2 is a structural schematic diagram of the turnplate in the present disclosure.

As shown in FIG. 2, the turnplate 8 includes a base, an atomization plane 23 and an air hole 24.

The base is a structure of a "T-shaped" longitudinal section constituted of an upper receiving portion 21 and a lower support portion 22. The upper surface of the receiving portion 21 is provided with a circular groove with a certain radius coaxial with the center of the receiving portion. The base is made of a material with a thermal conductivity less than 20 W/m/k.

The atomization plane 23 is a disc structure, matching with the circular groove and in interference fitting with the circular groove. The atomization plane 23 is made of a material with a wetting angle less than 90° to an atomized metal droplet 13. The atomization plane 23 is also provided with a concentric circle groove 25 matching the nozzle 14 with a plurality of small holes.

The air hole 24 is arranged passing through the receiving portion 21 and the support portion 22. The upper end of the air hole 24 is in contact with the lower end of the atomization plane 23, and the lower end of the air hole 24 is communicated with the outside world.

An induction heating coil 12 is also arranged outside the turnplate 8. The rotational speed of the turnplate 8 ranges from 10000 rpm to 50000 rpm. The induction heating coin 12 is connected with a frequency converter and a stabilized voltage supply arranged outside the housing 20. The heating thickness of the induction heating coil 12 ranges from 5 mm to 20 mm, and the voltage control of the stabilized voltage supply ranges from is 0 to 50 V.

The piezoelectric ceramic 1, the oscillation generator 3, the crucible 2, the nozzle 14, the plate electrode 7, the turnplate 8, the concentric circle groove 25 and the induction heating coil 12 are located coaxially from top to bottom of the apparatus. The purpose is for droplets can evenly drop on the center of the turnplate, and conducive to spread.

The volume of the housing 20 should be large enough make the centrifugally broken droplets fly onto the collection tray at the bottom, so as to ensure that the droplets will not solidify on the inner wall of the housing 20 The area of the collection tray 10 should be large enough to collect powder.

During operating, the mechanical pump 16 and the diffusion pump 17 are used to vacuumize the housing 20 and the crucible 2. The crucible 2 is provided at the bottom with a nozzle 14 with small holes. The heating tape 6 is used to heat the metal materials to-be-prepared in the crucible 2. A high-purity inert shielding gas, such as helium gas and argon gas, is introduced into the crucible 2 and the housing 20 through the crucible air inlet 4 and the cavity air inlet 15, to maintain a certain positive pressure difference between the crucible 2 and the housing 20. And then, the piezoelectric ceramic 1 is input pulse signals with a certain wave mode to make the oscillation generator 3 generate a certain frequency. Finally, the voltage of the plate electrode 7 is set to form an appropriate electric field. Because of the existence of the pressure difference between inside and outside of the crucible 2, the molten metal flows out through the nozzle 14 in a columnar metal flow. At this time the columnar metal flow is broken into a series of small metal droplets 13 under a certain frequency of oscillation. In the falling process of metal droplets, under the effect of electric field, the metal droplets 13 repel each other, due to the surface effect of electric charge, to avoid the repolymerization of metal droplets 13. The metal droplets 13 land freely on the turnplate 8 rotating at a high speed, which first drop in the concentric circular groove 25 in the center of the turnplate 8. Because the centrifugal force is small at this time, the droplets 13 will not disperse immediately, but spread in a circle on the turnplate 8. When the droplets spread in a certain range and the centrifugal force is large enough, the spread metal disperse on the turnplate 8 to the edge of the turnplate 8 in a fiber line shape under the action of centrifugal force, and finally split into tiny droplets to fly out. The tiny droplets solidify without a container in the falling process to form the metal powder 9 and fall onto the collection tray 10.

The present disclosure also discloses a method for efficiently preparing ultrafine spherical metal powder by means of drop-by-drop centrifugal atomization process, including the following steps:

S1. charging: charging the metal material into the upper crucible 2 arranged in the housing 20, and manually adjusting, in the height direction, the induction heating coil 12 to a position where a distance between the induction heating coil 12 and the turnplate 8 to a preset distance, then sealing the housing 20; wherein an added amount of the charged metal material accounts for ¼ to ¾ of a capacity of the crucible.

S2. vacuumizing: vacuumizing the crucible 2 and the housing 20 by using the mechanical pump 16 and the diffusion pump 17, and filling the crucible and the housing 20 with a high-purity inert shielding gas, to make the pressure inside the housing 20 reach a preset value.

S3. heating the crucible: setting heating parameters of the heating tape 6 according to a melting point of the metal material to-be-heated, monitoring the temperature inside the crucible 2 in real time by the thermocouple 19 arranged in the crucible 2, and maintaining the temperature after the metal is completely melted.

S4. induction heating: with a rotational speed preset, enabling the turnplate 8 to rotate at a high speed by using the motor 11, and heating the upper surface of the turnplate 8 rotating at the high speed, to a temperature higher than a melting point of the metal material by using the induction heating coil 12; wherein an induction heating voltage of the induction heating coil 12 ranges from 0 to 50 V, and an induction heating time ranges from 5 minutes to 15 minutes.

S5. making the powder: introducing a high-purity inert shielding gas into the crucible 2 by using the crucible air inlet 4 arranged on the housing 20 and extending into the crucible 2, to form a positive pressure difference between the inside and the outside of the crucible 2; then inputting a pulse signal with a certain wave mode to the piezoelectric ceramic 1, so that the oscillation generator 3 produces a certain frequency of oscillation; and then, setting the voltage of the plate electrode 7 to form an electric field of a preset intensity.

During the making process, the molten metal flows out, because of the existence of the pressure difference between the inside and the outside of the crucible 2, through the nozzle 14 in a columnar metal flow. At this time the columnar metal flow is broken into a series of small metal droplets 13 under a certain frequency of oscillation. In the falling process of metal droplets 13, under the effect of electric field, the metal droplets 13 repel each other, due to the surface effect of electric charge, to avoid the repolymerization of metal droplets 13.

The metal droplets 13 land freely on the turnplate 8 rotating at a high speed, which first drop in the concentric circular groove 25 in the center of the turnplate 8 and gradually spill over the groove.

Because the centrifugal force is small at this time, the droplets will not disperse immediately, but spread in a circle on the turnplate 8. When the droplets spread in a certain range and the centrifugal force is large enough, the spread metal disperse on the turnplate 8 to the edge of the turnplate 8 in a fiber line shape under the action of centrifugal force, and finally split into tiny droplets to fly out. The tiny droplets solidify without a container in the falling process to form the metal powder 9 and fall onto a collection tray 10.

S6. collecting the particles: collecting the metal powder by the collection tray 10 arranged at the bottom of the housing.

Embodiment 1

A batch preparation of Sn63Pb37 alloy spherical powder is as follows:

The raw material of Sn63Pb37 is charged to the crucible 2 after ultrasonic vibration cleaning, and the added amount of the Sn63Pb37 is up to ¾ of the capacity of the crucible 2. The heating tape 6 is installed on the crucible 2, and the thermocouple is inserted inside the crucible 2. The selected turnplate 8 is installed on the motor 11. The induction heating coil 12 is installed around the turnplate 8 and is 1 mm higher than the turnplate 8, and then the housing 20 is sealed.

The housing 20 and the crucible 2 is pumped to a low vacuum below 5 Pa by using the mechanical pump 16, and then the housing 20 and the crucible 2 are pumped to a high vacuum of 0.001 Pa by using the diffusion pump 17. A high-purity inert shielding gas of argon gas is introduced into the housing and the crucible through the crucible air inlet 4 and the cavity air inlet 15 to make the pressure inside the housing 20 and crucible 2 reach 0.1 MPa.

The crucible 2 is heated by the heating tape 6 to 300° C. with a heating speed of 15° C./min, and the temperature is kept for 10 minutes, so that all the metal materials in the crucible 2 are melted into the melt 5.

The rotational speed of the turnplate 8 is 24000 r/min by using the motor 11. The induction heating voltage of the induction heating coil 12 is set at 21 V, the induction heating current is set at 8 A, and the induction heating time is set at 10 minutes. The surface of turnplate 8 rotating at a high speed is heated to a temperature above the melting point of the metal material of 183° C.

The voltage of the plate electrode is set at 300 V. The high-purity inert shielding gas of argon gas is introduced into the crucible 2 through the crucible air inlet 4, to make a positive differential pressure of 50 kPa between the crucible 2 and the housing 20. A pulse signal of trapezoidal wave with frequency 1 MHZ is input to the piezoelectric ceramic 1 to make the piezoelectric ceramic 1 oscillate up and down. The oscillation is transmits to the melt 5 in the area near the nozzle 14 by the oscillation generator 3 connected with the piezoelectric ceramic 1, so that the melt 5 is sprayed through the nozzle 14 with small holes to form uniform metal droplets 13. The uniform metal droplets 13 land freely on the turnplate 8 rotating at high speed. The uniform metal droplets 13 first fall into the concentric groove 25 in the center of the turnplate 8 and gradually spill over the groove, and spread, under the action of centrifugal force, in a fibrous shape on the turnplate 8 to split into tiny droplets to fly out. The tiny droplets solidify without a container in the falling process to form the metal powder 9 and fall onto the collection tray 10. The collection tray can be a ring-shaped disk or disk.

After the preparation is completed, stop inputting the pulse signal of trapezoidal wave to the piezoelectric ceramic 1, that is, stop spraying the droplets. Stop the motor 11 rotating at a high speed, thereby the turnplate 8 stops rotating. Close the heating tape 6 and the induction heating coil 12. The metal powder 9 is removed from the collection tray 10 after the temperature decreased to room temperature. At last, the cavity air inlet 15 and the crucible air inlet 4 is closed, and the crucible 2 and the housing 20 are pumped to a low vacuum below 5 Pa by using the mechanical pump 16, so as to make the apparatus in a vacuum state when stopped.

Figure 3:
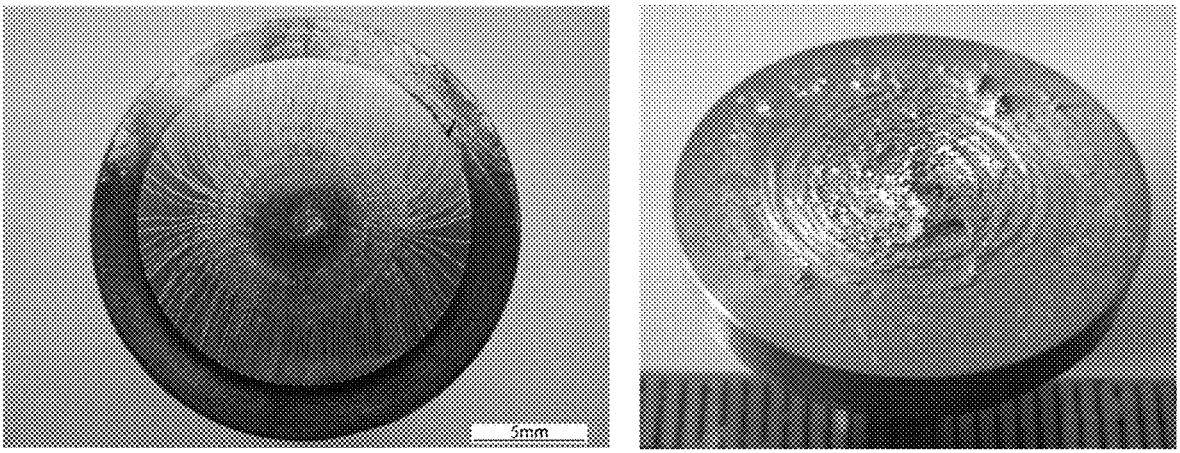
FIG. 3 is a comparison diagram between a surface of the turnplate in the present disclosure after an experiment and that of an original turnplate after an experiment; wherein, panel (a) is a surface of the turnplate with fibrous splitting, and panel (b) is a surface of the turnplate in the prior art.

As shown in FIG. 3, panel (b) is an atomization plate obtained after atomization in the prior art. Because the wettability between the materials of the atomization plate and the prepared metal powder is too small and the temperature of the turnplate during the atomization process is too low, resulting that the metal liquid is split in a film shape and there's a thick solidified liquid film on the atomization surface. The surface of the liquid film is too rough to atomize the subsequent metal droplets well, thereby affecting atomization effect and atomization efficiency seriously. FIG. 3 panel (a) is an atomization surface obtained by using the method in the present disclosure. It can be seen that the atomization mode is transformed into an obvious fibrous splitting mode, which greatly improves the fineness and production efficiency of the metal powder.

At last, it should be stated that the above various embodiments are only used to illustrate the technical solutions of the present invention without limitation; and despite reference to the aforementioned embodiments to make a detailed description of the present invention, those of ordinary skilled in the art should understand: the described technical solutions in above various embodiments may be modified or the part of or all technical features may be equivalently substituted; while these modifications or substitutions do not make the essence of their corresponding technical solutions deviate from the scope of the technical solutions of the embodiments of the present invention.

The invention claimed is:

1. An apparatus for preparing metal powder, comprising a housing, a crucible, and a powder collection area arranged below the crucible, wherein the crucible is provided with a thermocouple extending into an interior of the crucible, a heating tape wrapped around an exterior of the crucible, a nozzle with a plurality of perforations in a bottom of the crucible, an oscillation generator extended into the interior of the crucible and connected with a piezoelectric ceramic arranged on a top of the housing, and a plate electrode arranged below and adjacent to the crucible, wherein the housing is provided with a crucible air inlet connected to the interior of the crucible, a diffusion pump, a mechanical pump, a cavity air inlet, and a cavity exhaust valve, wherein the powder collection area comprises a collection tray arranged at a lower part-of the housing, and a turnplate arranged between- the collection tray and the crucible, and the turnplate is connected to a motor for driving the turnplate, wherein the turnplate comprises a base, an atomization plane and an air hole, and the base comprises an upper receiving portion and a lower support portion, wherein an upper surface of the receiving portion is provided with a circular groove-coaxial with a center of the receiving portion, wherein the base is made of a material with a thermal conductivity of less than 20 W/m*k, wherein the atomization plane is a disc that is in an interference fitting with the circular groove;

wherein the atomization plane is made of a material with a wetting angle less than 90° to an metal droplet, and the atomization plane further has a concentric circle groove in alignment with the perforated nozzle, wherein the air hole extends through the receiving portion and the support portion, and an upper end face of the air hole is in contact with a bottom of the atomization plane, and a lower end of the air hole is vented; and an induction heating coil is disposed around the turnplate and configured to induction heat the turnplate.

2. The apparatus according to claim 1, wherein a wetting angle between a material of the crucible and a melt in the crucible is greater than 90°.

3. The apparatus according to claim 1, wherein an aperture of the perforations of the nozzle ranges from 0.02 mm to 2.0 mm.

4. The apparatus according to claim 1, wherein a voltage applied to the plate electrode ranges from 100 V to 400 V, the induction heating coil is connected to a frequency converter and a stabilized voltage supply arranged outside the housing, a heating thickness of the induction heating coil ranges from 5 mm to 20 mm, and a voltage control range of the stabilized voltage supply is 0 V to 50 V.

5. The apparatus according to claim 1, wherein a rotational speed of the turnplate ranges from 10000 rpm to 50000 rpm.

6. The apparatus according to claim 1, wherein the piezoelectric ceramic, the oscillation generator, the crucible, the nozzle, the plate electrode, the turnplate, the concentric circle groove, and the induction heating coil are -coaxially arranged.

7. A method for preparing metal powder using an apparatus of claim 1, comprising:

S1. charging: charging a metal material into the crucible arranged in the upper portion of the housing, and manually adjusting, in a vertical direction, a distance between the induction heating coil and the turnplate to a preset distance, then sealing the housing;

S2. vacuumizing: vacuumizing the crucible and the housing by using the mechanical pump and the diffusion pump, and filling the crucible and the housing with an inert shielding gas to increase a pressure inside the housing to reach a preset value;

S3. heating the crucible: setting heating parameters of the heating tape according to a melting point of the metal material, monitoring a temperature inside the crucible in real time by the thermocouple arranged in the crucible, and maintaining the temperature after the metal material is completely melted;

S4. induction heating: enabling the turnplate to rotate by using the motor, and heating the upper surface of the rotating turnplate to a temperature higher than a melting point of the metal material by using the induction heating coil;

S5. making the powder: introducing an inert shielding gas into the crucible through the crucible air inlet to generate a positive pressure difference between inside and outside of the crucible; then inputting a pulse signal to the piezoelectric ceramic so that the oscillation generator generates a certain frequency of oscillation; and setting the voltage applied to the plate electrode to form an electric field of a preset strength, wherein the molten metal exits the crucible due to the positive pressure difference between the inside and the outside of the crucible through the nozzle to form a columnar metal flow, wherein the columnar metal flow is broken into metal droplets under a certain frequency of oscillation, and in the falling process of the metal droplets and under the effect of an electric field, the metal droplets repel each other due to the surface effect of electric charge to avoid aggregation of the metal droplets, the metal droplets land on the rotating turnplate in the concentric circular groove in the center of the turnplate and first spill over the groove in a circular path on the turnplate, and then disperse on the turnplate to an edge in a line shape under an action of centrifugal force, and further split into droplets to fly out; the droplets solidify to form the metal powder and fall onto the collection tray; and S6. collecting the metal powder: collecting the metal powder by the collection tray arranged at the bottom of the housing.

8. The method according to claim 7, wherein an added amount of the metal material ranges from ¼ to ¾ of a capacity of the crucible.

9. The method according to claim 7, wherein the inert shielding gas is argon or helium gas, which is filled into the housing to make the pressure in the housing reach 0.1 MPa.

10. The method according to claim 7, wherein an induction heating voltage of the induction heating coil ranges from 0 to 50 N, and an induction heating time ranges from 5 to 15 minutes.

* * * * *